United States Patent [19]

Gaibler et al.

[11] Patent Number: 4,782,920

[45] Date of Patent: Nov. 8, 1988

[54] LOAD-LIFTING MAST ESPECIALLY ADAPTED FOR USE WITH AUTOMATICALLY-GUIDED VEHICLES

[75] Inventors: Dennis W. Gaibler, Gresham, Oreg.; Jeffrey R. Skinner, Camas, Wash.; Alan T. Edwards, Portland, Oreg.

[73] Assignee: Cascade Corporation, Portland, Oreg.

[21] Appl. No.: 10,830

[22] Filed: Feb. 4, 1987

[51] Int. Cl.[4] ..... B66B 9/20

[52] U.S. Cl. ..... 187/9 R; 187/25; 74/89.15; 318/615

[58] Field of Search ..... 187/9 R, 9 E, 17; 182/19, 63, 141, 148; 74/89.15, 89.1 R, 424.8 R; 414/21, 674, 671, 665, 629, 630, 641; 254/273; 318/600

[56] References Cited

U.S. PATENT DOCUMENTS

| | | | |
|---|---|---|---|
| 2,653,679 | 9/1953 | Hamiton, Jr. | 187/9 R |
| 3,224,529 | 12/1965 | Gandolfo | 182/14 |
| 3,416,109 | 12/1968 | Gandolfo et al. | 335/59 |
| 3,568,804 | 3/1971 | Olsen | 187/25 |
| 3,612,221 | 10/1971 | Branham | 187/84 |
| 3,701,442 | 10/1972 | Dunning et al. | 187/9 R |
| 3,818,302 | 6/1974 | Ruthledge | 318/600 |
| 3,965,761 | 6/1976 | Stanley | 74/89.15 |
| 4,130,183 | 12/1978 | Tjornemark | 187/9 R |
| 4,131,029 | 12/1978 | Harbaugh et al. | 74/89.15 |
| 4,206,829 | 6/1980 | Melocik | 180/290 |
| 4,265,337 | 5/1981 | Dammeyer | 187/9 E |
| 4,280,205 | 7/1981 | Dammeyer | 367/119 |
| 4,411,582 | 10/1983 | Nakada | 414/636 |
| 4,499,971 | 2/1985 | Luebrecht et al. | 187/9 R |
| 4,548,298 | 10/1985 | Born | 187/25 |
| 4,567,757 | 2/1986 | Melocik et al. | 73/129 |
| 4,598,797 | 7/1986 | Schultz | 187/9 E |
| 4,599,555 | 7/1986 | Damiano et al. | 323/351 |

*Primary Examiner*—Joseph J Rolla
*Assistant Examiner*—Kenneth Noland
*Attorney, Agent, or Firm*—Chernoff, Vilhauer, McClung & Stenzel

[57] ABSTRACT

A load-lifting mast especially adapted for an automatically-guided, driverless vehicle has automatic features for ensuring accuracy and reliability of operation despite the absence of a driver. For load-lowering purposes, a slack chain sensor senses whether or not the load-supporting carriage is supported by the mast, and the carriage is withdrawn from the load when no support by the mast is indicated. The slack chain sensor also cooperates with a carriage height control system by overriding it to cause lowering past a target height until the carriage is supported independently of the mast. A carriage height sensor self-calibration system continually recalibrates the height-sensor readings automatically while the mast is in use to compensate for height sensor slip, chain stretching, and other mechanical variables. The stack chain sensor cooperates with the self-calibration system to enable it to reference to the ground or other surface upon which the vehicle travels to compensate for such other variables as tire wear. The mast is preferably powered by an electric motor-driven screw member having a wear-preventing, universal-joint-type connection to the carriage-lifting mechanism to prevent the imposition of unsymmetrical loading on the screw member. The electric motor has field effect transistor controls operable over a wide range of source voltages.

17 Claims, 6 Drawing Sheets

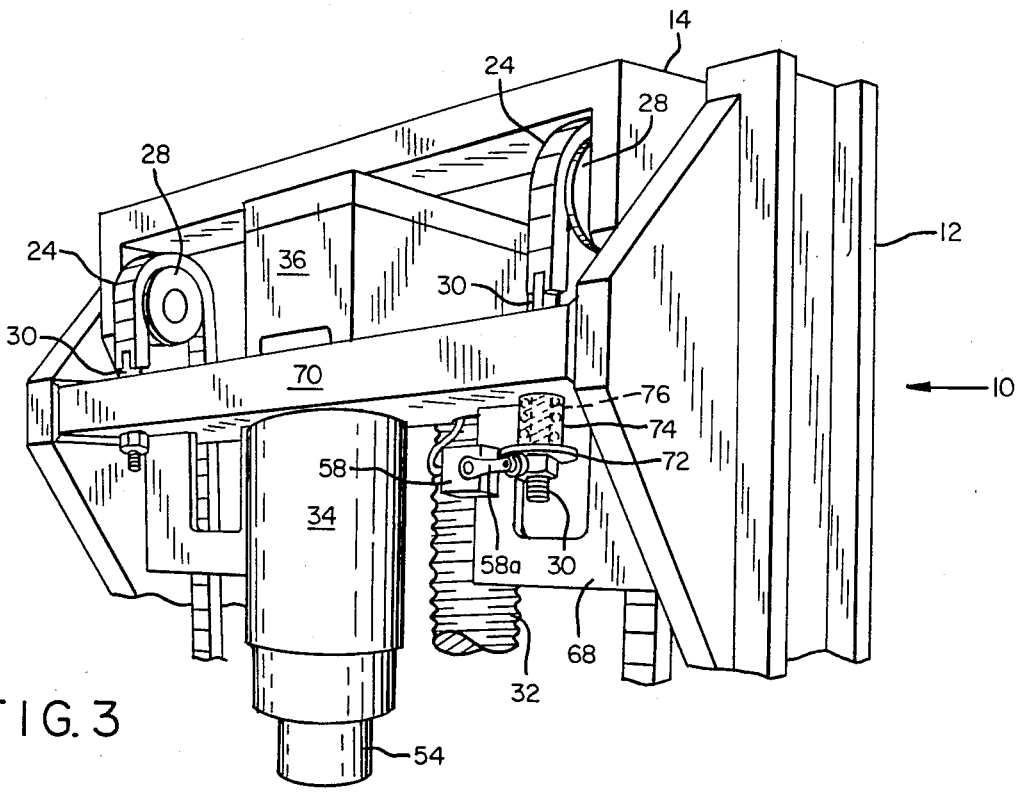
FIG. 3
FIG. 2
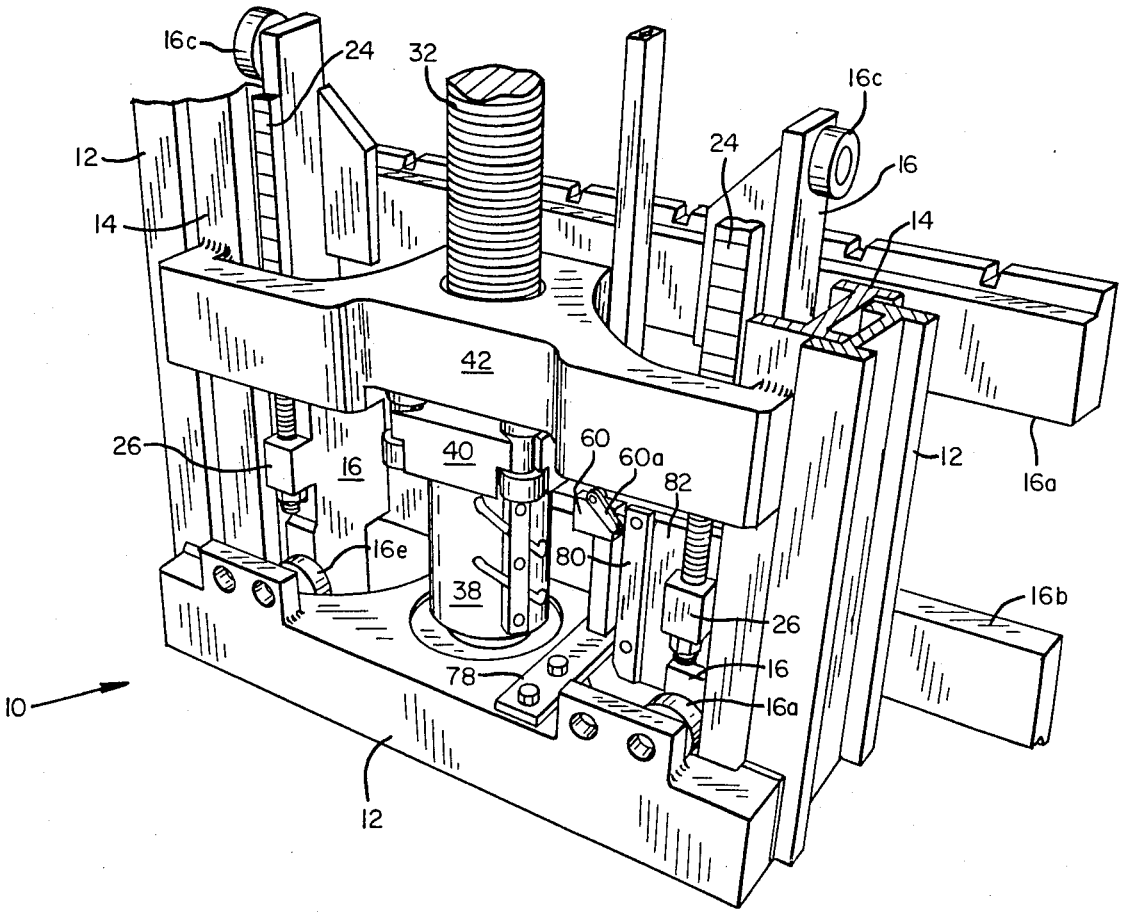

CARRIAGE LOWERING AND LOAD DEPOSITING

SCREW MEMBER SELF TEST

REFERENCING OF HOME ELEVATION TO GROUND

CALIBRATION OF HEIGHT SENSOR

LOAD-LIFTING MAST ESPECIALLY ADAPTED FOR USE WITH AUTOMATICALLY-GUIDED VEHICLES

BACKGROUND OF THE INVENTION

The present invention relates to load-lifting masts for load lifting and transporting vehicles. Although not limited to use with automatically-guided vehicles, it is especially adapted to compensate for the absence of a driver in such vehicles.

Load-lifting masts of both the screw-driven type and the hydraulically-driven type have long been used on driver-type industrial trucks and, more recently, on automatically-guided vehicles. Some of these masts have been equipped with automatic sensors of various types.

For example, mast slack chain sensors have been used for safety reasons to interrupt further lowering of a mast to prevent sudden load drop, as shown in Gandolfo U.S. Pat. Nos. 3,224,529 and 3,416,109, Branham U.S. Pat. No. 3,612,221 and Luebrecht et al. U.S. Pat. No. 4,499,971. However, such sensors have not been used to solve the unrelated problem of proper load depositing by automatically-guided vehicles. Normally such vehicles control load depositing solely by comparing sensed carriage height to a target height, operating on the assumption that there is a supporting surface at the target height which can accept the deposited load. However, if the load is not yet fully supported when lowered to the target height, or becomes fully supported before being lowered to such height, serious load depositing malfunctions can result from such reliance on height sensing. For example, when stacking loads on top of other loads, the proper height for load depositing can vary dramatically with time due to load compression, temperature and humidity conditions, such that a system for depositing loads which is referenced solely to predetermined heights would be unworkable.

Carriage height sensors have long been used on load-lifting masts for automatically and nonautomatically-guided vehicles alike, as shown for example in Rutledge U.S. Pat. No. 3,818,302, Tjoernemark U.S. Pat. No. 4,130,183, Melocik U.S. Pat. No. 4,206,829, Dammeyer U.S. Pat. Nos. 4,265,337 and 4,280,205, Nakada U.S. Pat. No. 4,411,582 and Schultz U.S. Pat. No. 4,598,797. The problem with all such height sensors, however, is in maintaining their accuracy. Inaccuracies develop rapidly in such sensors because of the lifting mechanisms themselves, which are susceptible to wear, chain stretch and maladjustment due to the heavy usage which they experience. Moreover, the relationship of the mechanism with respect to the ground or other vehicle-supporting surface also varies due to such factors as tire wear. All of these factors result in the frequent, recurring introduction of error into carriage height sensor readings. Such errors can be temporarily corrected by manual recalibration of the sensors, but this is far too time-consuming to be done while the mast is in use. Where the mast is mounted on a driver-type vehicle, such errors may not be particularly critical since the driver can compensate for them. However, where the mast is mounted on an automatically-guided vehicle, the continuous accuracy of height sensor readings is critical, and any frequently recurring errors are therefore unacceptable.

Likewise, because the continued ability of the mast to lift and hold a load on command are vital to an automatically-guided vehicle having no driver to notice and correct malfunctions, testing of such functions should be carried out on a relatively continuous basis during use of the mast, rather than on an intermittent service basis as is normal. Although Melocik et al. U.S. Pat. No. 4,567,757 recognizes the importance of such testing with respect to the operability of automatically-guided vehicle brakes, neither the need nor the means for automatic testing of load-lifting mast functions while in use has been previously suggested.

The preferable powered lifting mechanism for an automatically-guided vehicle mast is a vertically-oriented screw member rotatably driven so as to reciprocate a drive nut vertically. However, interfacing such a screw member with a load-lifting mast presents problems caused by the unsymmetrical loading of the mast. The mast will virtually always be subjected to a forward and downward load moment due to the forward protrusion of the load relative to the mast and, if the load is not centered with respect to the mast, will experience side moments as well. Moreover, horizontal forces in both fore-and-aft and transverse directions are to be expected in the handling of loads. Such moments and forces, if transmitted to the nut and screw member, can cause damaging warping and wear, detracting from the needed accuracy and reliability of the mast. Although some trunnion-type interfaces, such as that shown in Olsen U.S. Pat. No. 3,568,804, have been developed for isolating vertical screw members from the moments and side forces imposed by their loads, such interfaces depend largely on tensile forces rather than compressive forces to lift the load, and their structures are therefore generally not strong enough to accept the degree of loading normally imposed upon a load-lifting mast.

An optimum mast for an electrically-powered vehicle, such as a battery-powered driver-type lift truck or automatically-guided vehicle, should employ the most efficient of power controllers, preferably field-effect transistors (FETs), for regulating its electric lift motor. However, the large variations in voltage which characterize battery power sources, due to variations in loading and charging state, present difficulties in the utilization of FETs because of the need for predetermined differences between source voltage and gate voltage to enable an FET to be turned on. Prior FET control circuits, such as that shown in Damiano U.S. Pat. No. 4,599,555, recognize this problem but solve it by means of relatively complicated gate voltage control circuitry. A much simpler gate control system is needed to facilitate the economical utilization of FETs for power control where source voltage is expected to vary substantially, not only for load-lifting masts but for all applications.

SUMMARY OF THE INVENTION

The present invention is directed to solving each of the foregoing deficiencies of the prior art.

The exclusive reliance, by previous masts for automatically-guided vehicles, on height sensing as the means of assuring proper load lowering and depositing, is remedied by providing the mast with a sensor for detecting whether or not the carriage is vertically supported by the mast, and using the output of that sensor as the primary criterion for determining whether it is appropriate to deposit the load. Preferably, the sensor cooperates with a carriage height-sensing and control system in order to control carriage speed and position during lowering, but overrides such system with respect to the determination of when to stop the lowering of the carriage and deposit the load. Under the control of the sensor, loads are deposited and disengaged properly regardless of variations in elevation of the depositing surface, and regardless of errors in the height sensing system.

Previous recurring errors in carriage height sensor readings due to mechanical variables, such as wear and chain stretch, are solved by repeated automatic calibration of the height sensor while the mast is in use. Preferably, the calibration is not merely with respect to the mast itself, but with respect t the ground or other surface which supports the vehicle so as to compensate for such additional variables as tire wear. The automatic self-calibration system also serves as a malfunction detector, disabling the system when the need for excessive recalibration is sensed.

Lifting and holding capability of the mast are ensured by repeated automatic self-testing which determines both that the lifting screw member of the mast turns properly when the brake is released, and that the brake properly prevents such turning when engaged. Again, these are automatic, in-use tests which require no significant interruption in the utilization of the mast.

Potentially damaging load moments and side loads which might be applied to the mast's vertical screw member are eliminated in the present invention by a compressive force-transmitting joint interposed between the nut of the screw member and the carriage-lifting member of the mast. The joint comprises a substantially horizontal, annular sliding surface surrounding the screw for permitting relative movement between the nut and the carriage-lifting member in multiple horizontal directions while transmitting compressive lifting force, and further comprises an annular spherical sliding surface surrounding the screw for permitting relative tilting movement about multiple horizontal axes between the same elements while likewise transmitting compressive lifting force.

Finally, the problem of FET gate control under conditions of variable source voltage is solved simply and economically by interconnecting the source with the gate of the FET in such a way as to establish a predetermined ratio between the magnitude of the voltage at the source and the magnitude of the voltage at the gate, so that gate voltage varies in proportion to source voltage. Preferably, the connection comprises a pair of resistors connected in series with each other and with the source, with a junction interposed in series between the resistors to which the gate is connected.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 2 is an enlarged, perspective rear view of the bottom portion of the mast of FIG. 1 in assembled condition.

FIG. 3 is an enlarged, perspective rear view of the top portion of the mast of FIG. 1 in assembled condition.

DETAILED DESCRIPTION OF THE INVENTION

General Arrangement

Figure 1:
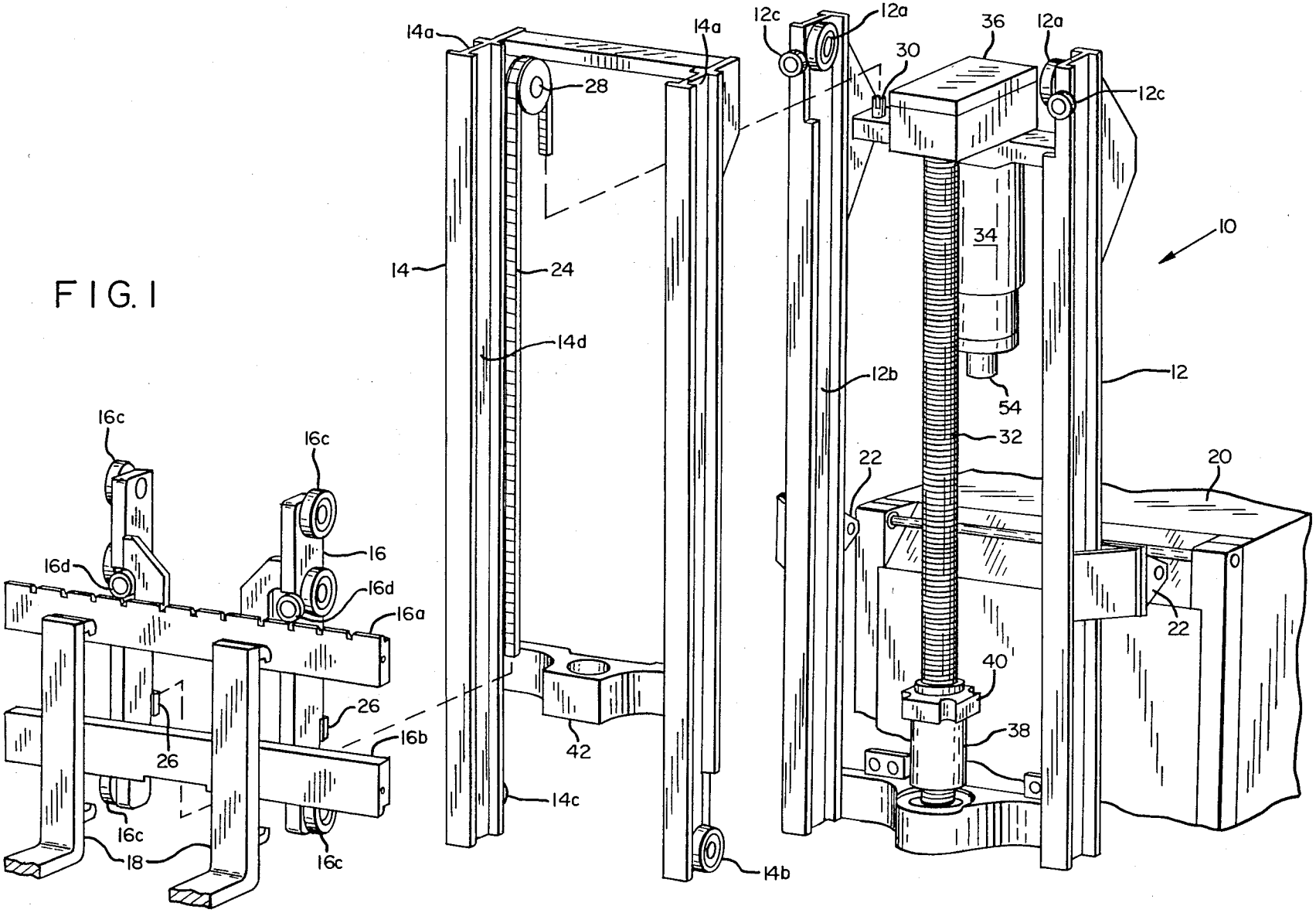
FIG. 1 is an exploded, perspective front view of an exemplary embodiment of a mast constructed in accordance with the present invention, also showing representative load-lifting forks for mounting on the mast carriage and an automatically-guided vehicle for mounting the mast.

A two-stage mast, indicated generally as 10 in FIGS. 1–3, comprises a base section 12, an upper section 14 movably mounted on the base section 12 so as to reciprocate vertically with respect thereto, and a load carriage 16 movably mounted on the upper section 14 so as to reciprocate vertically with respect to the upper section. Load-handling implements, such as a pair of forks 18, or a load clamp or load push-pull assembly if desired, are detachably mounted on supporting cross members **16*a* and 16*b* of the carriage so as to be selectively liftable thereby. The base section 12 of the mast is attached to a suitable vehicle, such as a conventional automatically-guided vehicle 20, by respective mounts 22**.

Vertical reciprocation of the upper section 14 with respect to the base section 12 of the mast is permitted by rollers **12*a* at the top of the base section, which nest within the outer channels 14*a* of the upper section 14, and rollers such as 14*b* on either side of the bottom of section 14 which nest within the inner channels 12*b* of the base section 12. These rollers are preferably adjustable in a fore-and-aft direction so as to ensure that the upper section 14 is plumb. Side rollers 12*c* on the base section and 14*c* on the upper section engage the edges of the opposing flanges of the opposite mast section to resist side loading and side tilting of the upper section 14**.

In like manner, the carriage 16 reciprocates vertically with respect to the upper mast section 14 by means of vertically-spaced rollers **16*c* which nest within the inner channels 14*d* of the upper section and which are also preferably adjustable in a fore-and-aft direction. Side rollers 16*d* on the front of the carriage and 16*e* (FIG. 2) on the rear of the carriage engage the inner edges of the front and rear flanges, respectively, of the upper section 14 to resist side loading and side tilting of the carriage 16**.

The power-driven apparatus for vertically supporting and vertically reciprocating the carriage 16 comprises the base section 12, upper section 14, a pair of lifting chains 24 extending from carriage chain anchors 26 over sprockets 28 to base chain anchors 30 on the base section 14, and a vertically-oriented screw member 32 rotatably driven by an electric motor 34 through a gear assembly 36 so as to vertically reciprocate a nut 38. The nut 38 is connected by a joint 40, to be described hereafter in greater detail, to the bottom of a cross member 42 of the upper mast section 14 so as to apply lifting force thereto while being preventing from rotating with respect to the screw member 32. Lifting force applied by the nut 38, due to rotation of the screw member 32, raises the upper mast section 14 with respect to the lower section 12 thereby causing each chain 24 to be pulled rearwardly over its respective sprocket 28 to raise the carriage 16 relative to the upper section 14. Rotation of the screw member 32 in the opposite direction either pulls the nut 38 downwardly, exerting a downward pulling force on the cross member 42 if necessary, or exerts dynamic braking by "plugging" of the motor 34 to control lowering speed under load. In either case, the carriage 16 is thus lowered relative to the section 14 while the section 14 is lowered with respect to the section 12.

Although an exemplary two-stage mast is described herein, it will be understood that a greater or lesser number of stages could be employed depending upon the range of lift needed. In a single-stage mast, the carriage 16 would be movably mounted directly on the base section 12 with its own integral crosshead being lifted by the nut 38, and with the chains 24 and upper section 14 being eliminated.

Electrical Circuitry

Figure 7:
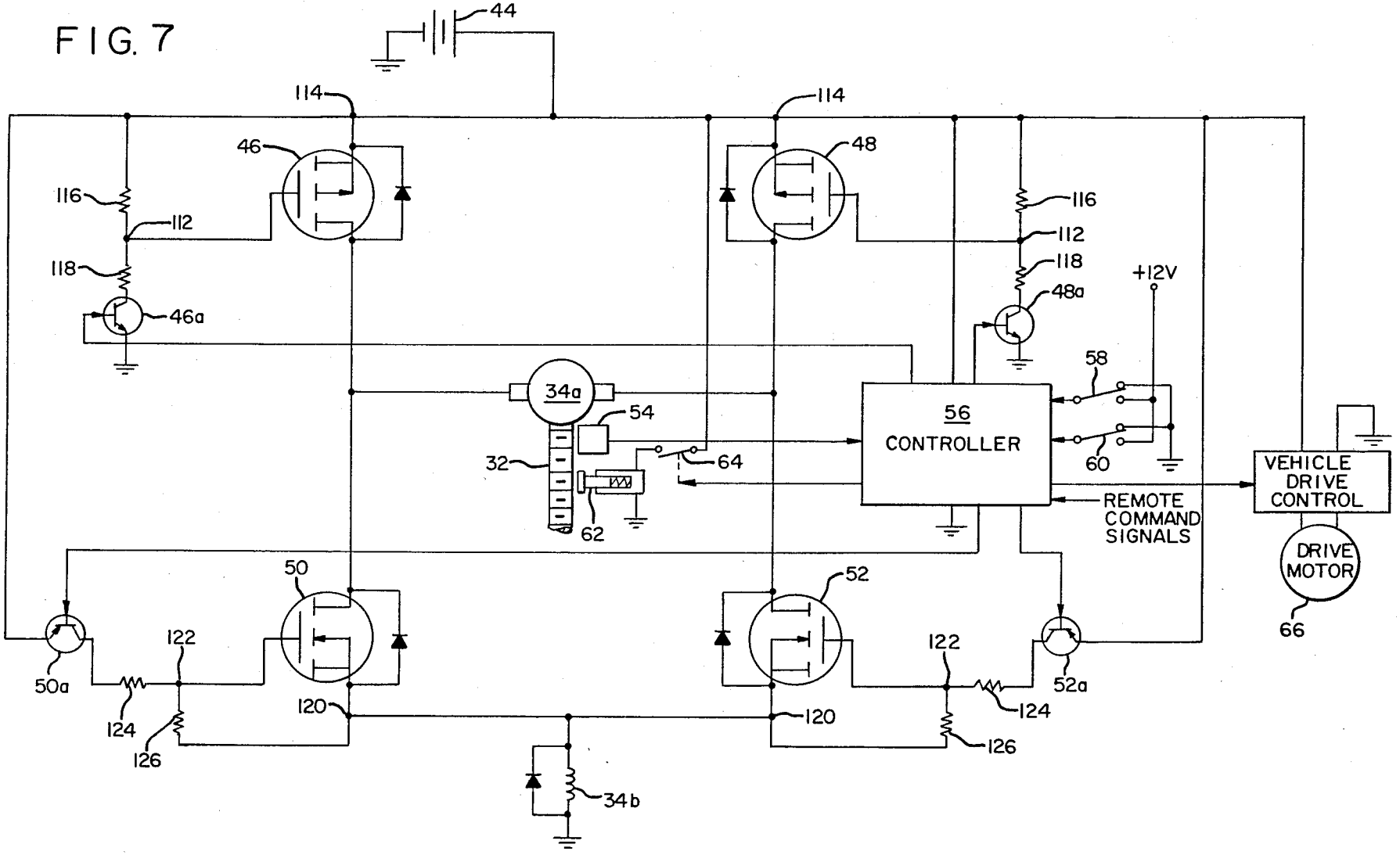
FIG. 7 is a simplified electrical circuit diagram showing the elements of the sensing, control, self-calibration and self-test systems of the mast.

FIG. 7 shows the basic circuitry for the elements of the present invention. Batteries 44 carried by the vehicle 20 constitute the power source for all mast functions. The mast motor 34, composed of armature 34*a* and field winding 34*b* as shown in FIG. 7, is controlled with respect to direction and speed by four MOSFETs 46, 48, 50 and 52, respectively, each being controlled in pulse-width modulated fashion by a respective transistor 46*a*, 48*a*, 50*a* and 52*a* under the direction of a conventional microprocessor-based controller 56 utilizing, for example, a Motorola 68008 microprocessor chip. The controller 56, which is mounted on the mast within the housing for the motor 34, in turn receives command signals from a remote master control through a connection to the vehicle 20 in a well-known manner. Powered rotation of the motor 34 in one direction is accomplished by activating FETs 46 and 52 to their conducting conditions so that pulsed current flows through FET 46 to the armature 34*a* and then to ground through FET 52, while FETs 48 and 50 are deactivated. Conversely, powered rotation of the motor in the opposite direction is accomplished by activating FETs 48 and 50 to cause reverse current flow through the armature 34*a* while deactivating FETs 46 and 52. Deactivation of all of the FETs stops the motor 34. A spring-engaged, solenoid-disengaged brake 62 is controlled by a relay switch 64 under the direction of the controller 56 so as to hold the screw member 32 against rotation by brake engagement whenever the motor 34 is stopped, and permit rotation by disengagement when the motor is actuated.

A conventional rotary encoder 54 senses carriage height and speed by sensing rotary angular displacement of the screw member 32, and feeds such data to the controller 56. Also, a slack chain sensor switch 58 signals the controller 56 whenever the carriage 16 is not vertically supported by the chains 24, and a calibration or "home" sensor switch 60 signals the controller 56 whenever the carriage is at a predetermined elevation for calibration purposes.

Carriage Lowering and Load Depositing

Raising of the carriage 16 to a predetermined elevation to engage a load is carried out by the controller 56 in a conventional, closed-loop positioning manner, with the controller receiving height command signals from the remote master control and comparing them with carriage height sensor readings from the height sensor rotary encoder 54 to control the motor 34. A representative system for accomplishing this function ( in combination with efficient motor speed control is shown in veal U.S. Pat. No. 4,491,776 which is incorporated herein by reference.

Conversely, carriage lowering and load depositing are controlled in a different manner in response to the aforementioned slack chain sensor switch 58. With reference to FIG. 3, the slack chain sensor switch 58 is mounted to a bracket 68 depending from the upper crosshead 70 of the base section 12 of the mast. The sensor arm 58*a* of the switch 58 engages a flange 72 of a downwardly spring-biased sleeve 74 which surrounds the threaded shaft of one of the chain anchors 30 which passes slidably through the crosshead 70. The strength of the spring 76 is sufficiently weak that, even though only the unloaded carriage 16 is supported vertically by the mast, the tension on the chains 24 imposed by the weight of the carriage is sufficient to overcome the spring 76. Thus, the sleeve 74 is held by chain tension in abutment with the underside of the crosshead 70 as shown in FIG. 3. In this position, the arm 58*a* of the switch 58 is in its normally-raised, upwardly-biased position and the switch 58 is in contact with ground as shown in FIG. 7. Conversely, whenever the carriage 16 is not vertically supported by the mast, such as when its forks 18 are resting on the ground or atop a load-supporting surface such as that of a load-holding rack or the top of another load, the chain 24 is no longer subject to lifting tension and the spring 76 pushes the sleeve 74 downwardly relative to the crosshead 70, causing the flange 72 likewise to push the arm 58*a* of the switch downwardly. This disconnects the switch 58 from ground and connects it to a positive voltage, thereby activating the switch and signaling the controller 56 that the carriage 16 is not vertically supported by the mast.

If the mast is of the single-stage type having no upper section 14 or chains 24, but rather having a carriage-lifting cross member such as 42 connected directly to the carriage 16, the switch 58 is instead mounted on the bottom of the cross member 42 with its arm 58*a* engaging the bottom edge of the joint 40. As explained hereafter in detail, the joint 40 is attached to the cross member 42 so as to permit limited vertical movement therebetween, and thus is capable of moving downwardly relative to the cross member 72 when the carriage is not being supported by the mast, just as the flange 72 moves downwardly relative to the crosshead 70 when the carriage is not supported by the mast. Obviously, there are other equivalent arrangements by which a sensor could be mounted on the mast so as to sense the presence or absence of carriage-supporting forces within the mast structure, all of which are intended to be within the scope of the present invention.

Figure 8:
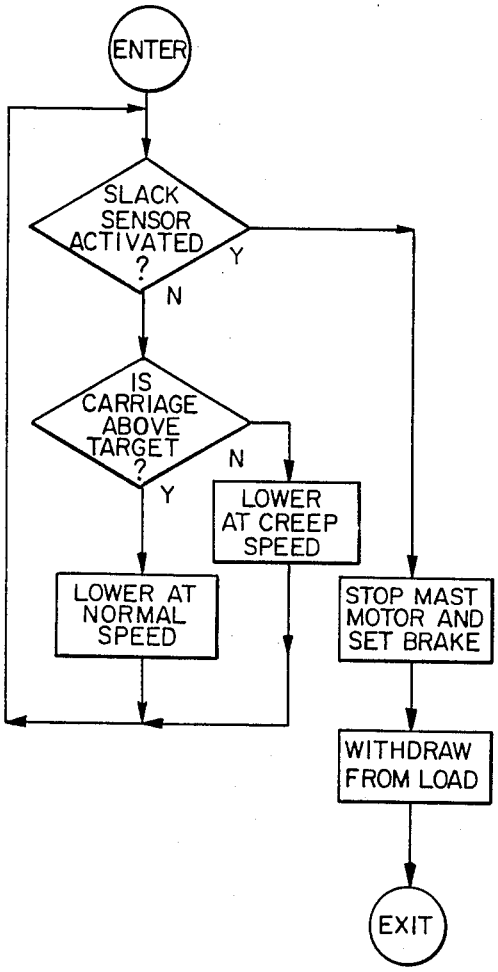
FIGS. 8–11 are simplified logic flow diagrams illustrating how the microprocessor-based mast controller is programmed to perform the functions of the foregoing systems.

The manner in which the controller 56 regulates carriage lowering and load depositing in response to the slack chain sensor 58 will be explained with reference to FIG. 8, showing an exemplary logic flow diagram according to which the controller 56 is programmed to carry out this function. As can be seen from FIG. 8, the condition of the slack chain sensor switch 58 is the primary criterion for determining when lowering of the carriage is to be stopped (by stopping the mast motor 34 and engaging the brake 62), and for determining when the carriage is to be withdrawn from the load. The specific nature of the withdrawal function will depend on the type of load-handling implement mounted on the carriage 16. For example, if forks such as 18 are mounted on the carriage, the controller accomplishes the withdrawal function by commanding the motor 34 to raise the carriage slightly after the activation of the switch 58, and then commanding the vehicle drive motor 66 to back the vehicle away from the load. Alternatively, if the load-handling implement is a load clamp, the controller directs the clamping motor to open the clamp arms slightly to disengage from the load, and then directs the vehicle drive motor 66 to back the vehicle away from the load. If the load-handling implement is a push-pull device, the controller directs the push-pull mechanism to extend in order to push the load off of the forks or platen, preferably while directing the drive motor 66 to back the vehicle away from the load at the same speed as that with which the push-pull assembly extends.

As indicated in the logic flow diagram of FIG. 8, the carriage lowering and load-depositing function does not totally ignore the carriage height sensor 54, but rather uses it as a secondary criterion in controlling the function, overriding it in favor of the signals received from the slack chain sensor 58 when appropriate. Thus, in the absence of activation of the slack chain sensor 58, the controller 56 causes the motor 34 to lower the carriage under normal lowering speed control until such time as either the slack chain sensor 58 is activated or the carriage height sensor 54 indicates that the carriage is no longer above a target elevation. In the former case, lowering is stopped even though the carriage may still be above the target elevation. In the latter case, the controller directs the motor 34 to continue lowering the carriage below the target elevation at creep speed until sensor 58 is activated. At this time the actual load-depositing elevation indicated by the carriage height sensor 54 can, if desired, be read and stored by the controller for future reference in retrieving the load.

As a result of the foregoing reliance on the slack chain sensor 58, both undershooting and overshooting of the proper load-depositing elevation is prevented, despite any variations in the elevations of the load-depositing surfaces or any height-sensor error. Moreover, this result is accomplished in a manner consistent with the ability to use efficient height-sensitive carriage speed control as shown, for example, in the aforementioned Veale U.S. patent.

Automatic Calibration of Carriage Height Sensor

As mentioned previously, the carriage height sensor 54 is preferably of the rotary encoder type, delivering pulses in proportion to the rotating angular displacement of the screw member 32 and thereby sensing the height of the carriage (as well as the velocity of rotation of the screw 32 and motor 34). Other types of carriage height sensors may alternatively be used for this purpose and are within the scope of the present invention.

A problem with all such height sensors, however, is their tendency rapidly to lose accuracy as indicators of true carriage elevation because of chain stretch, wear in the mast, slippage in the sensor itself, or changes in elevation of the entire mast relative to the ground or other vehicle-supporting surface due to such variables as tire wear. In order to overcome these difficulties, the controller 56 provides automatic, repetitive recalibration of the height sensor 54 not only with respect to the mast but also with respect to the ground.

In general, the automatic calibration function operates to reference the elevation sensed by the height sensor 54 to a predetermined value each time the carriage is positioned at a predetermined elevation in the course of its normal reciprocating movement while in use. The predetermined elevation can be arbitrarily selected and could, for example, be merely the surface upon which the vehicle is supported, with the slack chain sensor switch 58 indicating when the carriage is supported by such surface so that the reading of the sensor 54 can be referenced to zero. However, it is preferable that the predetermined elevation where the referencing takes place be at a position more frequently encountered by the carriage in normal use, i.e. above that where the carriage is supported by the ground, and that the predetermined value against which the height sensor reading is referenced therefore be greater than zero. Accordingly, in the embodiment shown herein, a "home" position sensor switch 60 as shown in FIG. 2 is mounted on the base section 12 of the mast by means of a bracket 78 in a position where its sensor arm **60*a* will be rotated from its normal position (connecting the switch 60 to ground) downwardly to its activated position (connecting the switch to a positive voltage) by contact with the bottom edge of a triggering bar 80 affixed to the rear of the carriage 16 by a bracket 82. Activation of the "home" position sensor 60 establishes the predetermined elevation where the reading of the height sensor 54** will be referenced to a predetermined value for calibration purposes.

Figure 10:
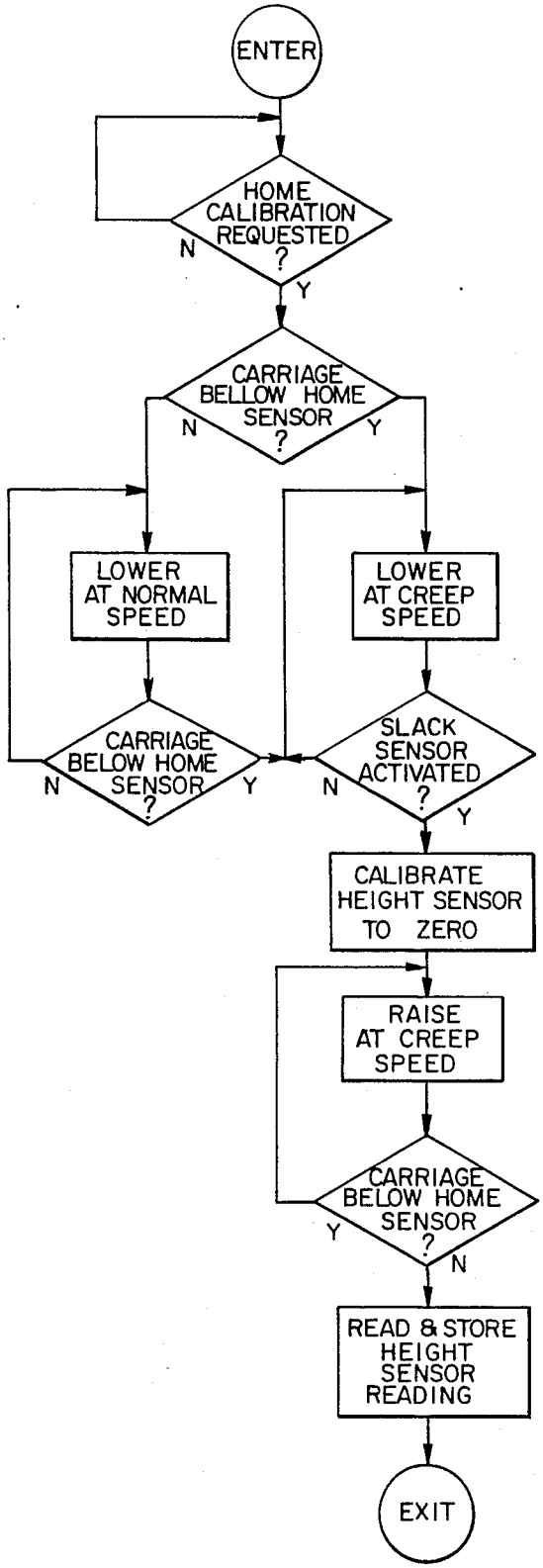
Figure 11:
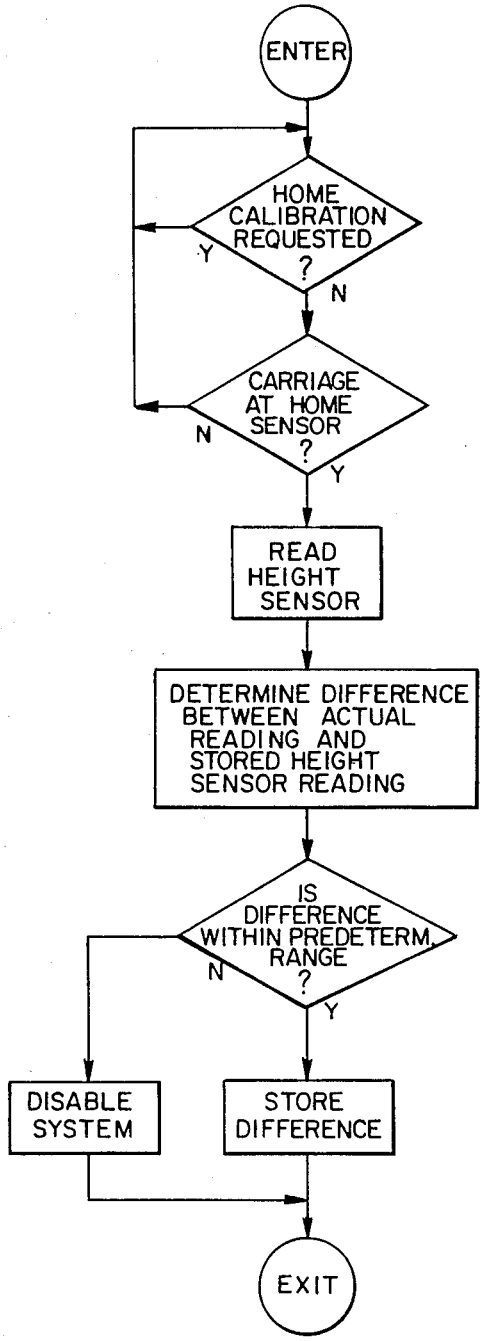

It is desirable that the predetermined elevation established by the "home" sensor switch 60 or, more specifically, the predetermined value associated therewith against which the height-sensor reading is to be referenced, be somehow referenced to the ground or other surface which supports the vehicle so that the variable of tire wear can be compensated for. Since such variable changes more slowly than do the mechanical variables of the mast structure, referencing of the "home" elevation to the ground need not be repeated with high frequency. Therefore, at any convenient time, such as the beginning of each work shift for the vehicle 20, the "home" elevation can be referenced to the ground by the controller 56 in accordance with the exemplary logic flow diagram of FIG. 10. The remote master control for the vehicle 20 issues a command to the controller 56 requesting referencing of the "home" elevation to the ground. Depending upon whether the carriage is above or below the "home" elevation, the controller causes the motor 34 to lower the carriage either at normal lowering speed or at creep speed until the slack chain sensor 58 is activated, indicating contact with the ground. Upon actuation of the slack chain sensor 58, the controller 56 sets the height-sensor 54 reading to zero and reverses the motor 34 to raise the carriage at creep speed. When the bottom edge of the trigger bar 80 on the carriage rises to a sufficient level to deactivate the "home" sensor switch 60, the height-sensor 54 is read and the value is stored as the predetermined value with respect to which the height-sensor reading will thereafter be referenced when the carriage is at the "home" elevation.

Thereafter, during normal use of the mast, the controller 56 repeatedly recalibrates the height-sensor 54, relative to the stored value corresponding to the "home" elevation, every time the trigger bar 80 activates the "home" sensor switch 60 (unless the above-described referencing of the "home" elevation to the ground is being requested). Each time the switch 60 is activated, the controller 56 reads the height-sensor 54, determines the difference between the height-sensor reading and the stored reading corresponding to the "home" elevation and, as long as the difference is within an arbitrarily predetermined maximum range, stores the difference. Such difference is then algebraically added to the height-sensor readings during the subsequent closed-loop height control of the carriage until a new calibration results in the storage of a new difference replacing the old difference. However, if the difference is outside of the predetermined maximum range, this indicates that abnormal chain stretch or other malfunction within the mast has occurred, in response to which the controller disables the system by preventing further actuation of the motor 34 and engaging the brake 62 while transmitting an error signal to the remote master control.

Self-Testing of Mast Screw Member

Figure 9:
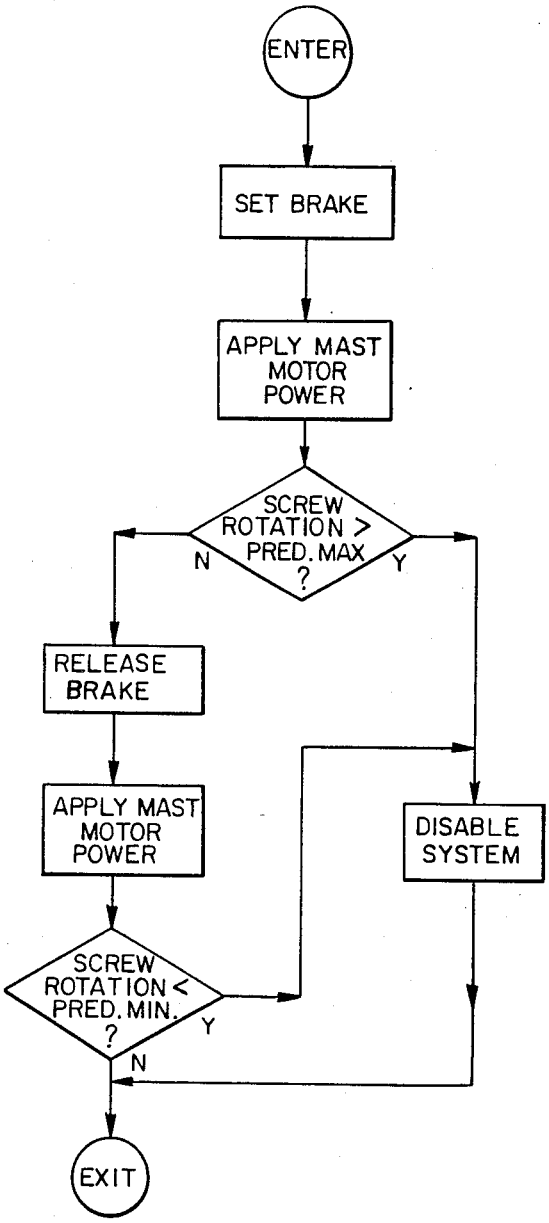

FIG. 9 is an exemplary logic flow diagram showing the programming of the controller 56 enabling it to test the operability of the screw member 32 to hold and lift a load as required, in response to a test command from the remote master control. Operability for holding a load is tested by the controller's opening of relay switch 64 (FIG. 7) to engage the spring-actuated brake 62 while actuating motor 34 to rotate the screw member 32. If the screw member 32 rotates beyond an arbitrarily predetermined maximum angular displacement, as indicated by the rotary encoder 54, the controller disables the system by preventing further actuation o the motor 34 in view of the lack of holding power provided by the brake 62. Alternatively, if screw rotation with the brake engaged is not greater than the predetermined maximum, the controller proceeds to test the operability of the screw member 32 to lift loads, and the ability of the brake to disengage properly, by actuating motor 34 and closing relay switch 64 to disengage the brake 62. The controller senses screw rotation, again through rotary encoder 54, and if the angular displacement is below an arbitrarily predetermined minimum the controller likewise disables the system by preventing further actuation of the motor 34 and engaging the brake 62. Both disabling functions are preferably accompanied by the transmission by the controller 56 of an error signal to the remote master control.

Screw Member Lifting Joint

Figure 4:
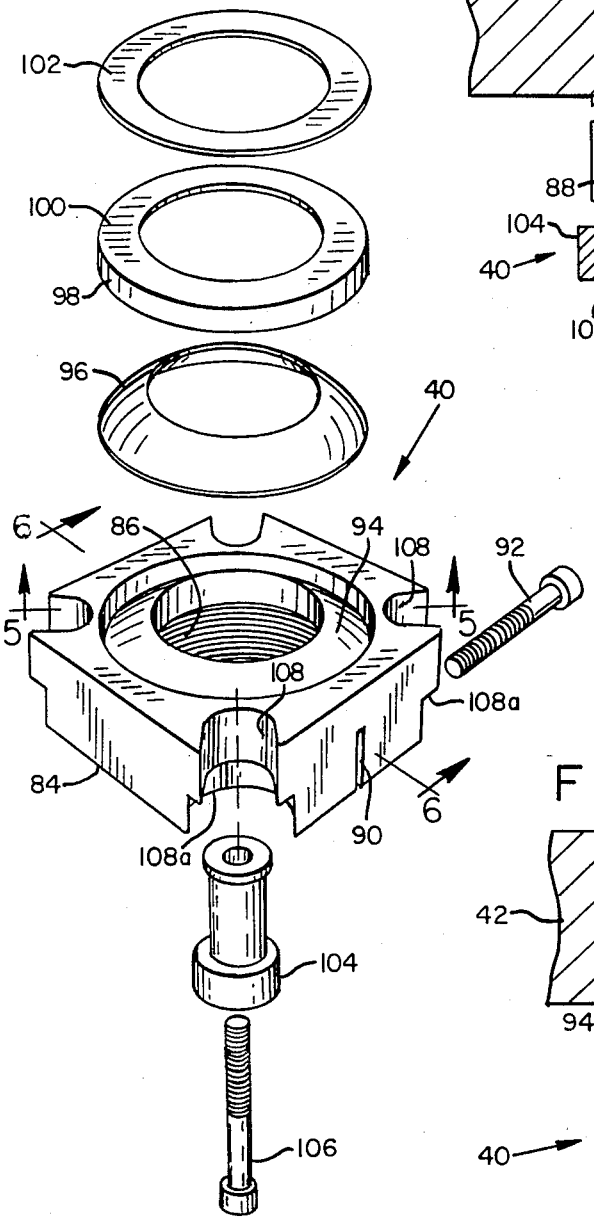
FIG. 4 is an enlarged, exploded view of the joint between the nut of the mast's screw member and the carriage-lifting cross member of the mast.
Figure 5:
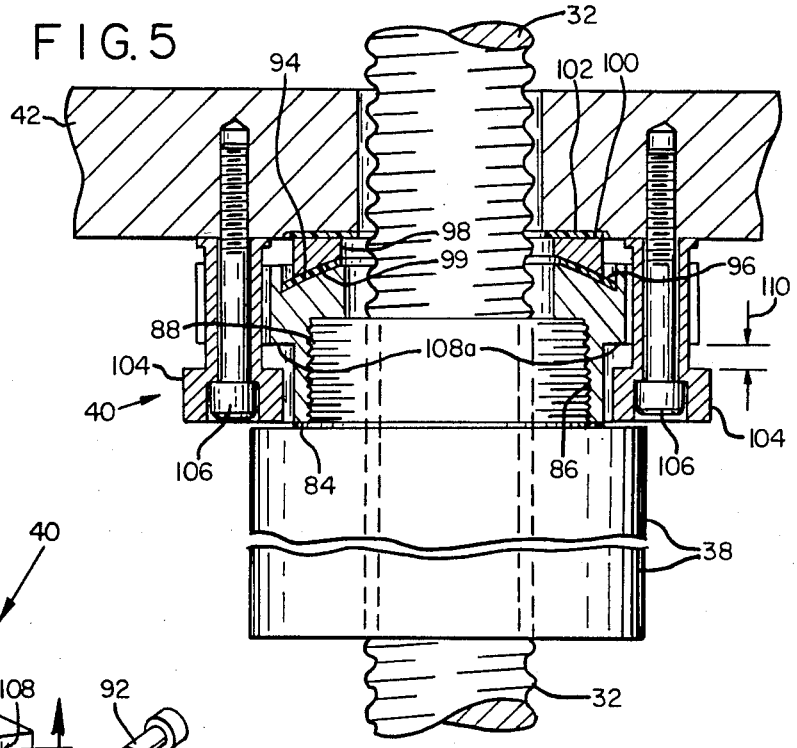
FIGS. 5 and 6 are sectional views of the joint of FIG. 4 taken along lines 5—5 and 6—6 of FIG. 4, respectively, and also showing the relationship of the joint to the nut and carriage-lifting member of the mast.
Figure 6:
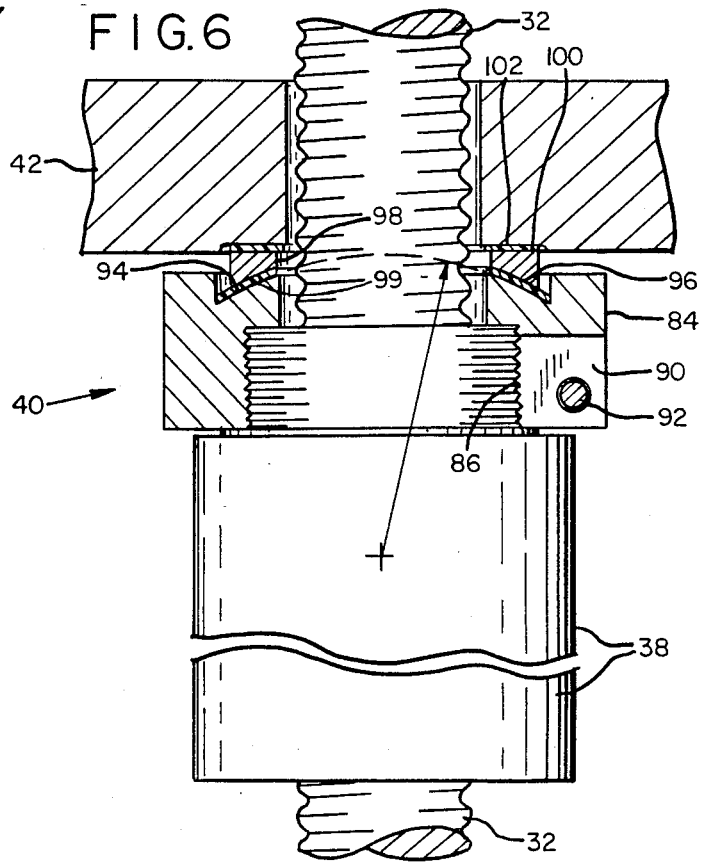

FIGS. 4–6 illustrate the structural details of the joint 40 interposed between the lifting nut 38 of the screw member 32 and the carriage-lifting cross member 42. The joint 40 comprises a main body 84 having a threaded aperture 86 for engaging mating threads 88 at the top of the nut 38. To ensure that the threads 88 of the nut are unable to turn relative to the body 84 after they have been threaded into the aperture 86, a slot 90 is formed through one side of the body 84 extending from the exterior of the body to the aperture 86. The slot permits a bolt 92, threaded into an aperture on one side of the slot 90, to clamp the threaded aperture 86 tightly around the nut threads 88 to prevent relative rotation.

The upper surface of the body 84 defines an upwardly-convex, annular spherical surface 94 upon which is a mating annular thrust bushing 96 of low friction material such as Teflon brand PTFE. Slidably mounted atop the thrust bushing 96 is an annular member 98 having a downwardly-concave, spherical surface 99 matingly engaging the thrust bushing 96 and having an upper horizontal surface 100 with a further annular PTFE thrust bushing 102 thereon, upon which rests the carriage-lifting cross member 42. The foregoing joint structure thus provides a horizontal sliding surface 100 surrounding the screw 32 for permitting relative sliding movement between the nut 38 and the crosshead member 42 in multiple horizontal directions, as well as a pair of mating, annular spherical sliding surfaces 94 and 99 surrounding the screw for permitting relative tilting movement between the nut 38 and crosshead member 42 about multiple horizontal axes. These sliding surfaces effectively prevent the transmission of both side loads and load moments to the nut 38 and screw member 32.

Attachment of the joint 40 to the cross member 42 is by means of four retainers 104 fastened to the cross member by bolts 106. Each retainer 104 fits loosely within a respective corner pocket 108 of the body 84 so that the body 84 is restrained against rotation by the cross member (thereby also restraining the nut 38 against rotation) while at the same time permitting limited vertical movement of the joint and nut relative to the cross member 42. Such limited vertical movement is indicated by the dimension 110 in FIG. 5, and is determined by the vertical clearance existing between the heads of the retainers 104 and the respective downwardly-facing lips **108*a* formed in the sides of the pockets 108. The loose vertical connection between the nut 38 and the cross member 42 ensures that no compressive forces can be exerted on the joint's various sliding surfaces by the tightening of the connecting hardware, and that the only compressive forces imposed upon such sliding surfaces are the carriage lifting forces so that relative sliding of the surfaces will not be impaired. The fact that relative vertical movement between the nut 38 and cross member 42 is limited, by the interference between the heads of the retainers 104 and the lips 108*a*, enables the nut 38 not only to lift the cross member 42 but also to exert downward pulling force thereon. This helps to insure that frictional forces do not impede downward movement of the carriage, which could otherwise leave the carriage in a condition supported only by frictional forces, rather than by the nut 38**, raising the danger of unexpected free-fall.

Fet Control Circuit

With reference to FIG. 7, the voltage of the battery power source 44 can vary substantially due to variations in loading and charging condition of the batteries. Because each of the FETs 46, 48, 50 and 52 can be actuated to its conducting condition only by the establishment of at least a predetermined difference between its gate voltage and source voltage, economical circuitry is provided for establishing a predetermined ratio between the source voltage and gate voltage of each FET. FETs 46 and 48, which are of the "P" channel type, require a gate voltage at the respective junctions 112 of a magnitude which is less, by at least a predetermined amount, than their respective source voltages at junctions 114 in order to be actuated to their conducting conditions. Such actuation occurs in response to pulsed signals from the controller 56 to transistors 46*a* and 48*a*, respectively, switching the transistors to their conducting modes and thereby permitting current to flow through a respective pair of resistors 116 and 118 which are connected in series on opposite sides of the junction 112 to which the gate of the respective FET is connected. The relative resistances of the respective resistors 116 and 118 thus establish a predetermined ratio between the source voltage and gate voltage when current is flowing through them, thereby ensuring that the gate voltage is lower than the source voltage by at least the amount necessary to actuate the FET, regardless of normal variations in the source voltage.

FETs 50 and 52 show the utilization of the same principle in connection with "N" channel FETs, wherein the source voltage is considered to be at junctions 120 and likewise varies due to changes in operation of the motor 34. With "N" channel FETs, the conducting condition of the FET requires that the gate voltage at respective junctions 122 be greater than the source voltage by at least a predetermined amount. Accordingly, to establish a predetermined ratio between the source voltage at junctions 120 and the gate voltage at junctions 122 and thereby ensure the necessary difference in voltages, a respective pair of resistors 124 and 126 are connected in series on opposite sides of each junction 122. When current flows through them in response to actuation of a respective transistor 50*a* or 52*a*, the predetermined voltage ratio between junction 120 and junction 122 is established, insuring that the gate voltage is sufficiently greater than the source voltage to actuate the respective FET 50 or 52.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A load-lifting mast for a load-carrying vehicle comprising:

(a) a load supporting carriage for supporting a load;
(b) power-driven means for vertically supporting and vertically reciprocating said carriage;
(c) sensor means connected to said power-driven means for sensing whether or not said carriage is vertically supported by said power-driven means; and
(d) motor means automatically responsive to said sensor means for withdrawing said carriage from said load in response to said sensor means sensing that said carriage is not vertically supported by said power-driven means, said motor means comprising means for selectively advancing and withdrawing said carriage horizontally relative to said load.

2. The apparatus of claim 1 wherein said sensor means comprises means for sensing the presence or absence of carriage-supporting forces within said power-driven means.

3. A load-lifting mast for a load-carrying vehicle comprising:

(a) a load-supporting carriage for supporting a load;
(b) power-driven means for vertically supporting and vertically reciprocating said carriage;
(c) sensor means connected to said power-driven means for sensing whether or not said carriage is vertically supported by said power-driven means;
(d) said power-driven means including carriage height-control means for predetermining an elevation to which said carriage is to be lowered; and
(e) override means responsive to said sensor means for causing said power-driven means to lower said carriage below said elevation until said sensor means senses that said carriage is not vertically supported by said power-driven means.

4. The apparatus of claim 3, including control means for regulating the speed at which said power-driven means lowers said carriage, said control means including means responsive to said sensor means for regulating said speed differently when said carriage is below said elevation than when said carriage is above said elevation.

5. A load-lifting mast for a load-carrying vehicle comprising:

(a) a load-supporting carriage for supporting a load;
(b) power-driven means for vertically supporting and vertically reciprocating said carriage;
(c) carriage height-sensor means for sensing the elevation of said carriage relative to a predetermined elevation;
(d) position sensor means for sensing when said carriage is at said predetermined elevation; and
(e) calibrating means responsive to said position sensor means for referencing the elevation sensed by said height-sensor means, when said carriage is at said predetermined elevation, to a predetermined value in response to said carriage being at said predetermined elevation.

6. The apparatus of claim 5 wherein said calibrating means includes means for determining the difference between said predetermined value and the elevation sensed by said height-sensor means when said carriage is at said predetermined elevation, said power-driven means including carriage height-control means for regulating the elevation of said carriage in response to said difference.

7. The apparatus of claim 5 wherein said calibrating means includes means for determining the difference between said predetermined value and the elevation sensed by said height-sensor means when said carriage is at said predetermined elevation, and means for comparing said difference to a predetermined difference and preventing said power-driven means from vertically reciprocating said carriage in response to said difference exceeding said predetermined difference.

8. The apparatus of claim 5, further including means for referencing said predetermined value to the surface upon which said vehicle travels.

9. The apparatus of claim 8, wherein said means for referencing said predetermined value comprises ground-sensor means for sensing when said carriage is supported by said surface, and means responsive to said position sensor means and said ground-sensor means for determining the difference between the respective elevations sensed by said height-sensor means when said carriage is at said predetermined elevation and when said carriage is supported by said surface, respectively.

10. A load-lifting mast for a load-carrying vehicle comprising:

(a) a load-supporting carriage for supporting a load;
(b) power-driven means for vertically supporting and vertically reciprocating said carriage;

(c) said power-driven means including a vertically-oriented elongate screw member rotatably driven by a motor for vertically reciprocating said carriage by the rotation of said screw member;
(d) selectively engageable brake means for preventing rotation of said screw member;
(e) sensor means for sensing the amount of angular rotation of said screw member;
(f) control means for causing said motor to drive said screw member while simultaneously causing said brake means to engage; and
(g) means responsive to said sensor means for transmitting a predetermined signal in response to the amount of angular rotation of said screw member, as sensed by said sensor means, exceeding a predetermined amount during engagement of said brake means.

11. A load-lifting mast for a load-carrying vehicle comprising:
(a) a load-supporting carriage for supporting a load;
(b) power-driven means for vertically supporting and vertically reciprocating said carriage;
(c) said power-driven means including a vertically-oriented elongate screw member rotatably driven by a motor for vertically reciprocating said carriage by the rotation of said screw member;
(d) selectively engageable and disengageable brake means for respectively preventing and permitting rotation of said screw member;
(e) sensor means for sensing the amount of angular rotation of said screw member;
(f) control means for causing said motor to drive said screw member while simultaneously causing said brake means to disengage; and
(g) means responsive to said sensor means for transmitting a predetermined signal in response to the amount of angular rotation of said screw member, as sensed by said sensor means, being less than a predetermined amount during disengagement of said brake means while said motor is driving said screw member.

12. A load-lifting mast for a load-carrying vehicle comprising:
(a) a load-supporting carriage for supporting a load;
(b) a vertically-oriented elongate screw rotatably driven by a motor;
(c) a nut member mounted on said screw for moving vertically in response to the rotation of said screw;
(d) a crosshead member selectively liftable by said nut member for lifting said carriage;
(e) joint means surrounding said screw and operatively interposed between said nut member and said crosshead member for transmitting lifting force from said nut member to said crosshead member, said joint means having a substantially horizontal, annular surface surrounding said screw for permitting relative movement between said nut member and said crosshead member in multiple horizontal directions while transmitting said lifting force, said joint means further having an annular spherical surface surrounding said screw for permitting relative tilting movement between said nut member and said crosshead member about multiple horizontal axes while transmitting said lifting force;
(f) connector means loosely connecting said joint means to one of said members for permitting limited relative vertical movement between said joint means and said one of said members; and
(g) said connector means including means for limiting relative rotation about a vertical axis between said joint means and said one of said members, further including additional connector means connecting said joint means to the other one of said members for limiting relative rotation about a vertical axis between said joint means and the other one of said members.

13. The apparatus of claim 12 wherein said spherical surface is upwardly convex.

14. The apparatus of claim 12 wherein said spherical surface is downwardly concave.

15. A load-lifting mast for a load-carrying vehicle comprising:
(a) a load-supporting carriage for supporting a load;
(b) power-driven means for vertically supporting and vertically reciprocating said carriage;
(c) sensor means connected to said power-driven means for sensing whether or not said carriage is vertically supported by said power-driven means;
(d) motor means automatically responsive to said sensor means for withdrawing said carriage from said load in response to said sensor means sensing that said carriage is not vertically supported by said power-driven means; and
(e) said power-driven means including carriage height-control means for predetermining an elevation to which said carriage is to be lowered, and override means responsive to said sensor means for causing said power-driven means to interrupt lowering of said carriage prior to reaching said elevation in response to said sensor means sensing that said carriage is not vertically supported by said power-driven means.

16. A load lifting mast for a load-carrying vehicle comprising:
(a) a load-supporting carriage for supporting a load;
(b) power-driven means for vertically supporting and vertically reciprocating said carriage;
(c) sensor means connected to said power-driven means for sensing whether or not said carriage is vertically supported by said power-driven means;
(d) motor means automatically responsive to said sensor means for withdrawing said carriage from said load in response to said sensor means sensing that said carriage is not vertically supported by said power-driven means; and
(e) said power-driven means including carriage height-control means for predetermining an elevation to which said carriage is to be lowered, and override means responsive to said sensor means for causing said power-driven means to lower said carriage below said elevation until said sensor means senses that said carriage is not vertically supported by said power-driven means.

17. The apparatus of claim 12 wherein said connector means includes a plurality of connectors interconnecting said joint means and said one of said members, said connectors being positioned substantially symmetrically about said screw.

* * * * *

UNITED STATES PATENT AND TRADEMARK OFFICE

CERTIFICATE OF CORRECTION

PATENT NO. : 4,782,920

DATED : November 8, 1988

INVENTOR(S) : Dennis W. Gaibler, Jeffrey R. Skinner and Alan T. Edwards

It is certified that error appears in the above-identified patent and that said Letters Patent is hereby corrected as shown below:

On the title page:

In the Abstract, line 16, change "stack" to --slack--.

Col. 6, line 57 Change "72" to --42--.

Col. 7, line 67 Delete "." before "however".

Col. 9, line 40 Change "o" to --of--.

Col. 10, line 55 Change "fet" to --FET--.

Signed and Sealed this

Tenth Day of April, 1990

*Attest:*

HARRY F. MANBECK, JR.

*Attesting Officer*

*Commissioner of Patents and Trademarks*